United States Patent [19]

Venot

[11] 3,946,546

[45] Mar. 30, 1976

[54] FALSE TWIST TEXTURING APPARATUS

[75] Inventor: Jean Venot, Villerest, France

[73] Assignee: Chavanoz S. A., Chavanoz, France

[22] Filed: Feb. 3, 1975

[21] Appl. No.: 546,359

Related U.S. Application Data

[63] Continuation of Ser. No. 459,711, April 10, 1974, abandoned.

[30] Foreign Application Priority Data

Apr. 19, 1973 France ..... 73.15059

[52] U.S. Cl. ..... 57/34 HS; 57/106

[51] Int. Cl.[2] ..... D01H 13/04; D01H 13/28

[58] Field of Search..... 57/34 R, 34 HS, 34.5, 56, 57/157 R, 157 MS, 157 TS, 106; 28/62

[56] References Cited

UNITED STATES PATENTS

| | | | |
|---|---|---|---|
| 2,891,375 | 6/1959 | Vandomme et al. | 57/34 HS |
| 3,051,364 | 8/1962 | Barnes et al. | 57/34.5 X |
| 3,066,471 | 12/1962 | Scragg | 57/34.5 |
| 3,165,881 | 1/1965 | Moncuit et al. | 57/34 HS |
| 3,241,234 | 3/1966 | Kiefer et al. | 57/34.5 X |
| 3,501,904 | 3/1970 | Batsch | 57/34 HS |
| 3,609,951 | 10/1971 | Hunter | 57/34 HS |
| 3,633,353 | 1/1972 | Wurmli | 57/34 HS X |
| 3,638,411 | 2/1972 | Tsugawa et al. | 57/34 HS |
| 3,793,817 | 2/1974 | Beringer | 57/34 HS |

FOREIGN PATENTS OR APPLICATIONS

| | | |
|---|---|---|
| 1,391,179 | 1/1965 | France |
| 1,206,826 | 8/1959 | France |
| 2,004,284 | 11/1969 | France |

OTHER PUBLICATIONS

*Textured Yarn Technology*, Vol. 2, "Stretch Yarn Machines" Monsanto Co. 1967.

*Textured Yarn Technology, Supplement '68;* Monsanto Co., 1968.

*Primary Examiner*—Donald E. Watkins

*Attorney, Agent, or Firm*—L. J. Wilburn; H. William Petry

[57] ABSTRACT

A machine for the false twist texturing of textile threads wherein the false twist textured threads are subjected to a second heat treatment, and including fluid pressure means for transporting the thread through the second heat treatment section of the machine to the thread take-up position to facilitate thread-up of the machine.

4 Claims, 2 Drawing Figures

FALSE TWIST TEXTURING APPARATUS

This is a continuation of application Ser. No. 459,711, filed Apr. 10, 1974, now abandoned.

The present invention relates to a machine for treatment of textile thread, and in particular, to means for transferring thread from a feed station to a receiving station through treatment components.

It relates more particularly to means for thread transfer on a machine which has considerable bulk, especially in height, such as a machine for treatment by fixed false twist.

It is known that a fixed false twist machine contains two heating components commonly called heaters, generally disposed in line, or in series, in the thread path with one another. In order to reduce the height, machines have been built containing two separate sides, one of the sides containing the supports for the thread supply or feed bobbins and the thread collection or receiving components, and the other cotaining the thread treatment components (heaters, false twist spindles) as well as the thread delivery or feeding components. The two sides of the machine are connected by a platform on which the operator can move, the path for the threads passing under the platform and at the top of the machine, above the operator's head. Such an arrangement is disclosed in U.S. Pat. No. 3,165,881.

However, the rise in treatment speeds has led to longer heaters in order to retain a sufficient heating time for the moving threads. The elongation of the heaters results in an increase in the height of the machines, so that the operator can no longer have ready access to the top of the machine under normal working conditions. For the passage of the thread, at least, it would be necessary to have access to the top of the machine. Furthermore, the passage of a series of threads through the treatment components is a delicate, long and fussy operation, which it is advisable to simplify while reducing the work of the operator in this regard.

The present invention proposes to bring a solution to the above problems. It relates to a machine for the treatment of thread by false twist which contains for each thread working position a thread supply station, a first thread advancing means, a first heating component, a false twist component, a second thread advancing means, a second heating component equipped with a heating channel for substantially rectilinear thread passage, a third thread advancing means situated on the axis of the thread passage channel, and a receiving station for the treated thread. At least a part of the second heating component and the third thread advancing means do not have to be directly accessible to the operator. The invention is characterized by the fact that, for the installation of the thread at each working position, there is provided pneumatic means for transporting the thread from the outlet of the second thread advancing means, substantially up to the receiving station.

According to a preferred form of embodiment, the pneumatic means of transportation comprises, in combination, the following components:

1. a first aspiration-to-waste component, capable of aspirating the thread at the outlet from the second thread advancing means;
2. means for introducing the thread into the channel of the second heating component;

3. means for circulating a current of fluid in the channel of the second heating component, this current being sufficiently powerful to transport the thread in free travel through and beyond the third thread advancing means while it is in open position; and
4. a pneumatic transportation tube having a thread inlet or mouthpiece situated in proximity to, and beyond, the third thread advancing means, and an outlet exiting in the vicinity of the thread receiving station.

Optionally, a second evacuation to-waste component may be provided in proximity to the receiving station.

The transportation fluid is advantageously a gaseous fluid, preferably compressed air.

Advantageously, the means for introducing the thread into the channel of the second heating component and the means for circulating a current of fluid in the channel are coupled. They are then embodied in the form of a movable blast head device situated at the entry of the second heating component. It is equipped with a blast duct and a thread guide positioning the thread above the outlet of the blast duct. The blast head device can occupy an ON position and an OFF position. In the ON position, its outlet is situated facing the inlet of the thread passage channel of the second heating component, and the fluid is fed into the blast duct. According to a preferred form of embodiment, the blast head pivots around a hollow shaft or tube which is substantially parallel to the axis of the channel of the second heating component. The passage of the fluid to the blast head is provided by the hollow shaft and a channel drilled in the wall of the shaft which communicates with the blast duct when the head is in the ON position. The blast head can serve two adjacent thread working positions.

Advantageously, the downstream end of the pneumatic transportation tube has a tip on which the aspiration head of a pneumatic thread manipulation gun may be removably attached. In this case, the force necessary to move the thread through the transportation tube can be created merely by the aspiration force of the pneumatic gun which is connected to a waste receptacle. The attachment of the thread to the thread collection member or reception support accessible to the operator is therefore accomplished with the pneumatic manipulation gun, after having detached it from the tip of the transportation tube. The passage of the thread in the first part of the thread treating path accessible to the operator and not served by the pneumatic transportation means is accomplished in regular manner. for example, manually.

The invention will be better understood with the aid of an example and the following drawings which are given by way of illustration and are not intended to limit the invention.

Figure 1:
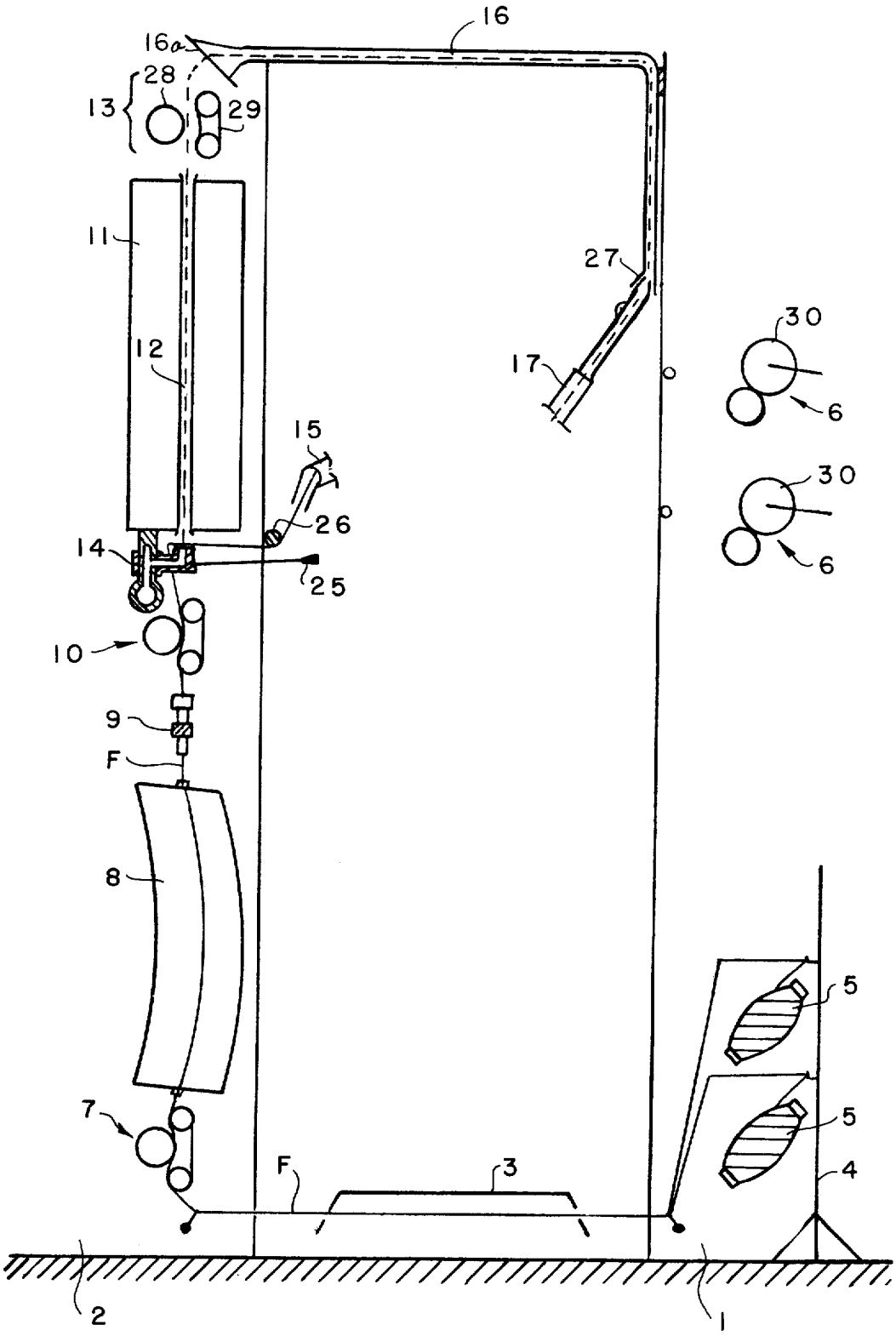
FIG. 1 represents, diagrammatically in side elevation, with portions in section, a fixed false twist texturing machine according to the invention.

The false twist machine represented in FIG. 1 is of the type containing two separate sides 1 and 2 connected by a platform 3 on which an operator can move. Side 1 carries supports 4 for thread feed or supply bobbins, such as 5, and thread take-up or receiving components 6, for the treated threads. Side 2, for each thread treatment position, carries first thread delivery or advancing means 7, a first heating component represented in the form of a curved, insulated tubular heater 8, a false twist component or spindle 9, a second thread advancing means 10, a second heating component shown as an insulated tubular heater 11 equipped with a heating channel or tube 12 for rectilinear passage of the thread, and a third thread advancing means 13 situated in alignment with the outlet end of channel 12. As shown, each of the thread advancing means comprise a roller which is driven by suitable means, not shown, and a cooperating belt which is movably positionable into and out of engagement with the surface of the driven roller. In operation, the belt is urged by suitable biasing means against the surface of the driven roller to engage a thread positioned therebetween and advance the same through the system. Other advancing means may be employed to advance the thread, if desired.

Only one thread working position is shown and described in FIG. 1; however, the false twist machine is composed of a plurality of such working positions located in side by side relation and extending along the length of operator platform 3.

According to the invention, the machine contains pneumatic means for transportation of the thread from the outlet of the second thread advancing means to the receiving station. These means comprise: a blast head device 14 situated at the base of the heater 11 and sending compressed air into the heating channel 12, an aspiration-to-waste device 15, which aspirates the thread between thread advancing means 10 and heating component 11, a pneumatic transportation tube 16 extending substantially from thread advancing means 13 to the vicinity of the thread receiving components or take-up packages 30, and a movable aspiration gun 17 removably attachable to the downstream end of tube 16. A thread cutter can be provided on the path of the thread running from the blast head device 14 to the aspiration or suction device 15. Advantageously, the thread cutter is fixed to the blast head device 14.

Figure 2:
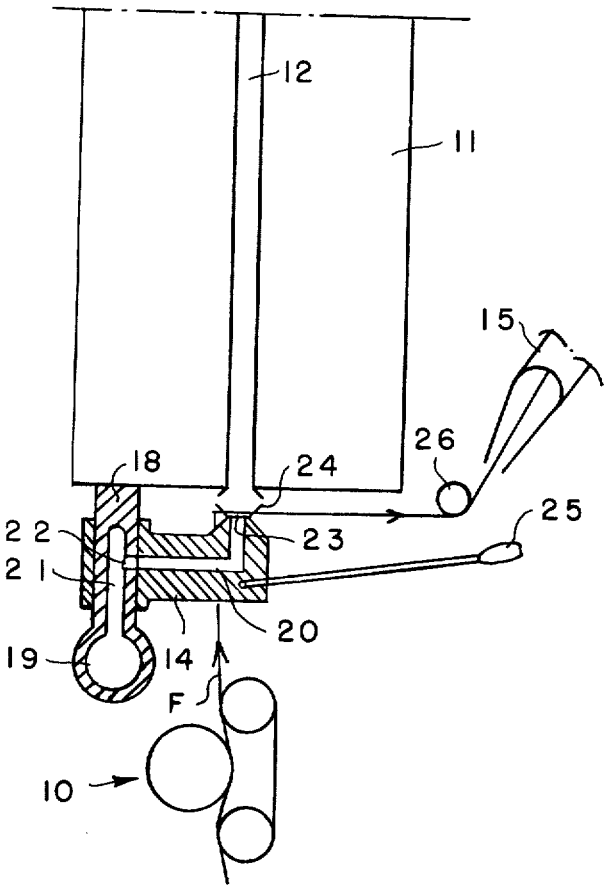
FIG. 2 is an enlarged view, with portions in section, of the fluid blast head of FIG. 1 which constitutes one of the means forming part of the invention.

Blast head device 14, seen in more detail in FIG. 2, is mounted pivotally around a hollow shaft or tube 18, for example, on the heater 11 and communicates with a compressed air feed duct 19. The blast head device is equipped with a duct 20 which can be connected to the bore 21 of the hollow shaft by a lateral duct 22 drilled in the thickness of the hollow shaft. Communication between ducts 20 and 22 is made when the head is in ON position. Blast duct 20 has an outlet orifice 23 which, in ON position, is situated facing the inlet of channel 12. A thread guide 24, disposed about the outlet orifice 23 from duct 20, makes it possible to position the thread above orifice 23. The pivoting of distribution or blast head device 14 is controlled by an operating rod 25. Advantageously, by pivoting in opposite directions, the blast head device can be used to serve the heating channels or tube 12 of two adjacent heaters 11, only one of which is shown. In this case, it is located to pivot about an axis equidistant from the heating channels 12 of each heater.

The transportation tube 16 (FIG. 1), with 90° elbow, contains a horizontal section and a vertical section. Its entry contains a mouthpiece 16*a* situated in the thread path above and overlying the exit of heating channel 12. Its outlet is equipped with a tip 27 to which the aspiration head of the pneumatic manipulation gun 17 can be removably attached.

The texturizing of thread on the false twist machine is described in the following example.

A thread F supplied from feed bobbins 5 is passed manually into the first thread advancing means 7, curved heater 8, twist spindle 9, second thread advancing means 10, and into the guide 24 of the blast head device 14 which is in OFF position. Then, after passage around bar 26, the thread is taken by the aspiration-to-waste device 15. The machine is started and the thread, textured and normally delivered by advancing means 10, is sent initially to waste by suction device 15. Aspiration gun 17, connected to tip 27, is actuated. Blast head device 14 is turned to the ON position and the thread is cut between guide 24 and bar 26. As the thread is dispensed by advancing means 10, it is transported through channel 12 by the compressed air ejected by the blast head device. The propulsion force is such that the thread, on leaving heating channel 12, continues to move along an extension of the axis of channel 12. It passes through advancing means 13 which is in open position, that is to say that it passes between driving roller 28 and the presser belt 29 which constitute thread advancing means 13. On leaving advancing means 13, the thread is sucked into mouthpiece 16*a*, is turned 90°, is taken over by the tube 16, then by gun 17, and it is sent to waste. The advancing means 13 is then engaged and blast head device 14 is turned to the OFF position. Gun 17 is disconnected from tip 27 and the thread dispensed by 13 and aspirated by gun 17 is transported by means of the gun to a thread receiving station 6 where it is attached to the rotating collection package 30. The thread-up of the thread working position is thus completed. Gun 17, the action of which is stopped, can be put in place at the outlet of the pneumatic transportation tube of the next working position, for thread-up or installation of the thread in that position.

The invention is not, of course, limited to the example described, but can contain numerous variations of the embodiment, with respect to both the blast head device and the transportation tube. Thus, there could be utilized as a transportation tube, a tube in which the current of transporting fluid is furnished by an aspiration-blast nozzle placed immediately below the mouthpiece.

The invention is applicable to the treatment by false twist of all thermoplastic threads.

That which is claimed is:

1. In a machine for the false twist texturing of textile threads in a plurality of side-by-side thread treating positions including two upstanding, spaced support frames positioned in facing relation, an operator walkway at the bottom of and extending between the frames to permit access to the thread treating positions, one of the frames supporting thread supply means in a lower portion thereof and thread take-up means in an upper portion thereof and the other frame supporting thread heaters and false twist spindles for treating the threads, and each of the thread treating positions having a thread path extending between the thread supply and take-up means being defined by a first thread advancing means positioned in a lower portion of the other frame for receiving thread from said thread supply means, a first thread heater positioned above said first thread advancing means and supported on said other support frame, a false twist spindle positioned above said first heater, second thread advancing means positioned above said spindle, a second thread heater positioned above said second thread advancing means and having a substantially straight heating tube for passage of the thread, the heating tube having an inlet for the thread adjacent the level of the head of an operator for receiving thread from said second advancing means and an outlet in an upper portion of said other frame above the head of an operator for exit of the thread from the heating tube, and third thread advancing means positioned above said outlet and situated generally on an extension of the longitudinal axis of the tube; the improvement therewith comprising pneumatic means for transporting the thread from the second thread advancing means, through the tube of the second heating means, through the third thread advancing means and to the vicinity of the thread take-up means, said pneumatic means including a pneumatic transportation tube extending across the walkway and having a thread-receiving mouthpiece situated above and in proximity to said third thread advancing means for receiving a thread therefrom and a thread outlet positioned adjacent said thread take-up means.

2. A machine as defined in claim 1 wherein said pneumatic means further comprises aspiration-to-waste means for collecting thread at the outlet of said second thread advancing means, and pneumatic pressure means operatively attached to said second heater for introducing thread into and passing it through the heater tube thereof, through the said third advancing means, and to the mouthpiece of said pneumatic transportation tube.

3. A machine as defined in claim 2 including aspiration-to-waste means for operatively communicating with said outlet of said pneumatic transportation tube to draw a thread through said tube for collection.

4. A machine as defined in claim 2 wherein said pneumatic pressure means for introducing the thread into the inlet of the heating tube of said second heater comprises a blast heat device having an air-dispensing outlet adjustably positionable into and out of alignment with the inlet of said heating tube for introducing pressurized air into the tube, and thread guide means thereon for positioning the thread on said air-dispensing outlet.

* * * * *